United States Patent [19]

Dillinger

[11] Patent Number: 4,830,606

[45] Date of Patent: May 16, 1989

[54] GAS LAMP AND CONTROL THEREOF

[76] Inventor: Bill R. Dillinger, 3923 Buckingham Dr., Brunswick, Ohio 44212

[21] Appl. No.: 153,313

[22] Filed: Feb. 8, 1988

[51] Int. Cl.[4] ..... F23Q 7/12

[52] U.S. Cl. ..... 431/255; 431/86; 431/87

[58] Field of Search ..... 431/18, 79, 80, 86, 431/87, 254–257

[56] References Cited

U.S. PATENT DOCUMENTS

| | | | |
|---|---|---|---|
| 3,330,133 | 7/1967 | Kniebes | 431/18 |
| 3,723,045 | 3/1973 | Reese | 431/18 |
| 3,837,787 | 9/1974 | Remy et al. | 431/255 |

*Primary Examiner*—Samuel Scott
*Assistant Examiner*—Noah Kamen
*Attorney, Agent, or Firm*—Watkins, Dunbar and Pollick

[57] ABSTRACT

An outdoor-type gas lamp is provided with a photovoltaic solar cell means, a rechargeable battery connected to the solar cell means, a normally-opened electromagnetic gas valve means, and an ignitor means connected to both the photovoltaic solar cell means and the rechargeable battery means, with the photovoltaic solar cell means generating a bins voltage that closes the flow of illluminating gas through the gas valve means and blocks the flow of energy from the battery means to the ignitor means when energized by daylight.

5 Claims, 2 Drawing Sheets

FIG. 3
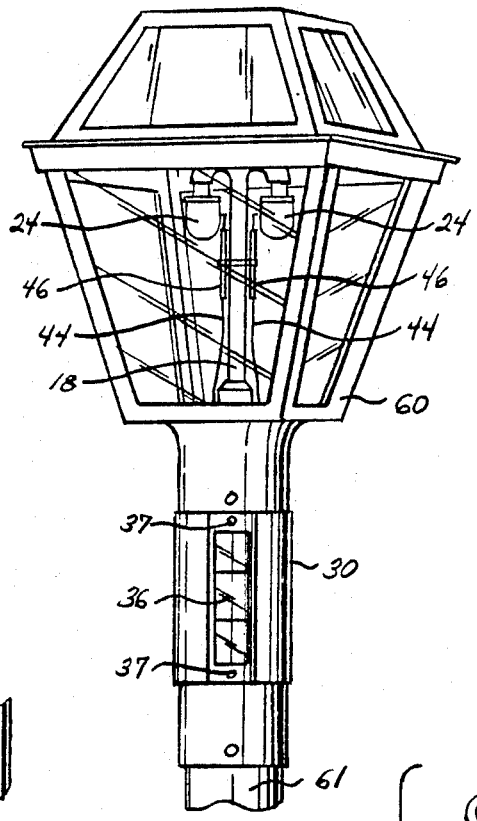
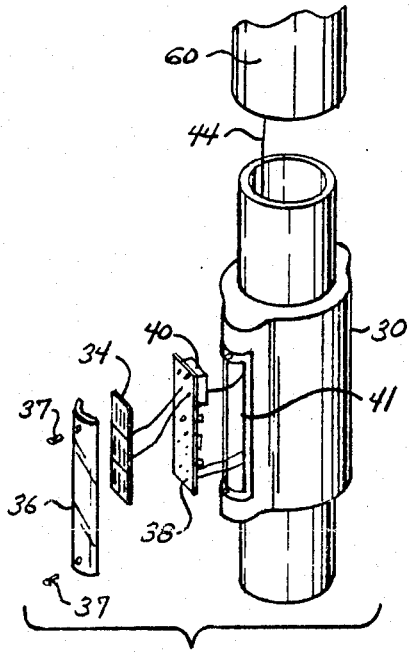
FIG. 4
FIG. 5
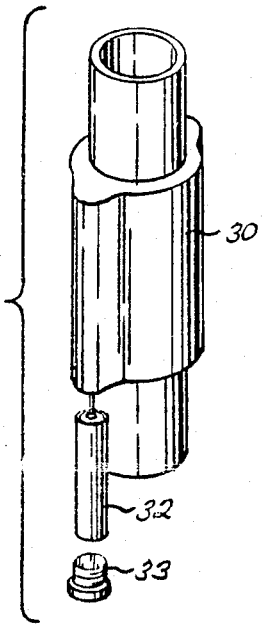

GAS LAMP AND CONTROL THEREOF

TECHNICAL FIELD

This invention pertains generally to gas lamps, and particularly concerns improved controls for automatically igniting gas lamps at the onset of darkness. The invention also includes features for ending the gas lamp ignition at the arrival of sunlight. More particularly, this invention relates to improvements in gas lamps of the outdoor "yard lamp" type.

BACKGROUND OF THE INVENTION

Although gas lamps and the ignition of gas burners dates back many years, in more recent times gas lamps have been used as outdoor lighting in residential neighborhoods to provide aesthetic and safety lighting near the residences. Until the recent increases in flammable gas prices, in most instances natural gas, such "yard lights" were frequently installed with the general plan that they would be lighted manually and burn continuously i.e. day and night. The cost of natural gas was low relative to electricity and the cost of fuel for such gas lamps was considered more or less inconsequential compared to the convenience and safety of having a lighted yard during all of the hours of darkness. In recent years the cost of natural gas has increased to the point where a relatively fewer number of yard lights are being installed. In many neighborhoods, previously installed outdoor as lamps have been turned off. Many have been replaced with electric lamps and others remain unused.

The economic situation for the use of these lamps, is substantially improved if these gas burning lamps are equipped to be turned off in the morning, or as natural daylight increases sufficiently, and turned on in the evening when the natural daylight reduces to the point that they have useful value. It is an object of this invention to provide automatic control mechanisms and circuits to operate a gas appliance and particularly an outdoor yard light automatically and to meet the need as described above.

The automatic control of gas ignition is well known in the art. Examples of systems suitable for automatic fuel gas ignition are given in U.S. Pat. No. 3,154,135 to La Pointe, U.S. Pat. No. 3,196,928 to La Pointe et al, and U.S. Pat. No. 4,298,335 to Riordan. Such systems typically accomplish their automatic start-up sequence in response to either thermostatic element or manual contact input signals.

Ignition control of illuminating gas systems is generally known and examples of such systems are given in U.S. Pat. No. 3,358,474 to Liesse and U. K. Patent Application No. GB 2074713A. Such illuminating systems have generally been electrical in nature but are responsive in their operation to manual contact initiation.

I have discovered that illuminating gas lamps and the like may be advantageously constructed and operated to automatically ignite in response to surrounding light conditions s as to be activated by diminishing or diminished environmental light and additionally to be shut-off by the presence of adequate surrounding light.

SUMMARY OF THE INVENTION

The gas lamp control of this invention utilizes a photovoltaic solar cell means, a rechargeable battery means, a normally-open electromagnetic gas valve means, and an ignitor means. The elements of the invention are combined so that a bias voltage is generated by the photovoltaic cell when energized by daylight to close the gas valve and prevent operation of the ignitor means. Upon sensing a diminished environmental light the bias of the photovoltaic solar cell is reduced, the gas valve means is allowed to open the flow of illuminating gas to the lamp outlet, and the ignitor means is activated to ignite the illuminating gas in the vicinity of the lamp's mantle elements.

The foregoing and other advantages of the invention will become apparent from the following disclosure i which a preferred embodiment of the invention is described in detail and illustrated in the accompanying drawings. It is contemplated that variations in structural features and arrangement of parts may appear to the person skilled in the art, without departing from the scope or sacrificing any of the advantages of the invention.

BRIEF DESCRIPTION OF THE DRAWINGS

FIG. 3 is a perspective view of the upper portion of an outdoor yard light having the control system of this invention.

FIG. 4 is an exploded perspective view of a portion of the control system of this invention.

FIG. 5 is an exploded view of the other side of the control system shown in FIG. 4.

DETAILED DESCRIPTION OF THE INVENTION AND BEST MODE

Figure 1:
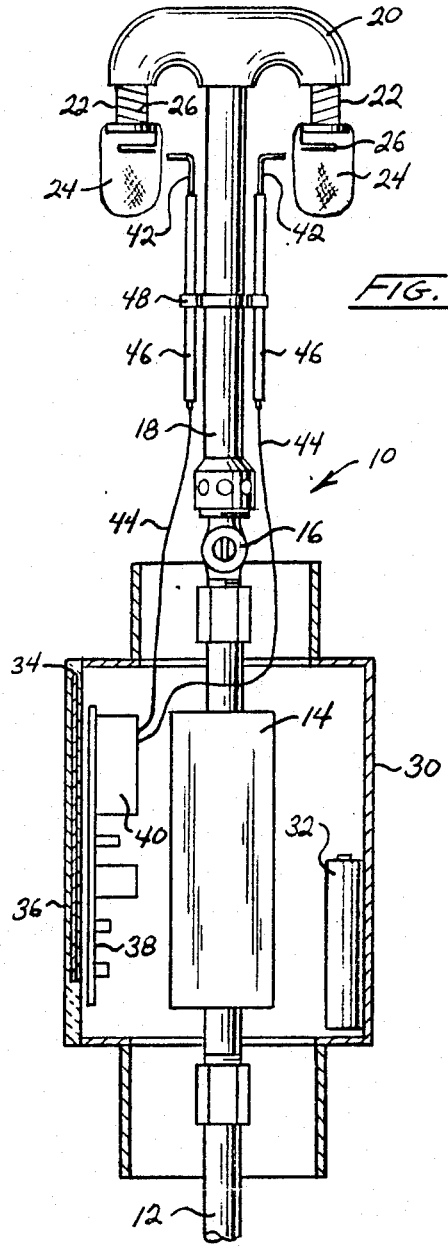
FIG. 1 is a partially sectional elevational view of a gas lamp incorporating the solar powered control of this invention.

FIG. 1 illustrates a gas lamp 10 incorporating the control of this invention. Gas lamp 10 is connected to a gas supply line 12 that provides natural gas or other illuminating gas to the assembly. Assembly 10 also includes a normally-opened electromagnetic gas valve 14, an adjustment valve (manual) 16, a gas venturi 18, an inverted mantle head 20, mantel tips 22, and mantels 24. Mantel tips 22 are non-metallic in nature; the remainder of the elements, except for the mantles, are metallic in nature and serve to conduct electricity to ground in the operation of this invention. Ground wires 26 extend from head 20 and are wrapped around mantle tips 22 in order to complete a circuit to ground that extends near the lamps ignitors. Conventional tubing and compression fittings join the various elements together as shown in the drawings.

Gas lamp 10 includes a housing 30 and within housing 30 are located a rechargeable battery 32, a photovoltaic solar cell 34, a clear light-collecting lens 36 which covers the solar cell, and a circuit board 38 that includes the principle components of the ignitor module 40. See FIG. 2. Ignitor module 40 is mounted upon the circuit board and is connected to ignitors 42 by the electrical wires designated 44. Wires 44 are positioned within insulating sleeves 46 and are secured to the lamp gas venturi 18 by bracket 48.

Figure 2:
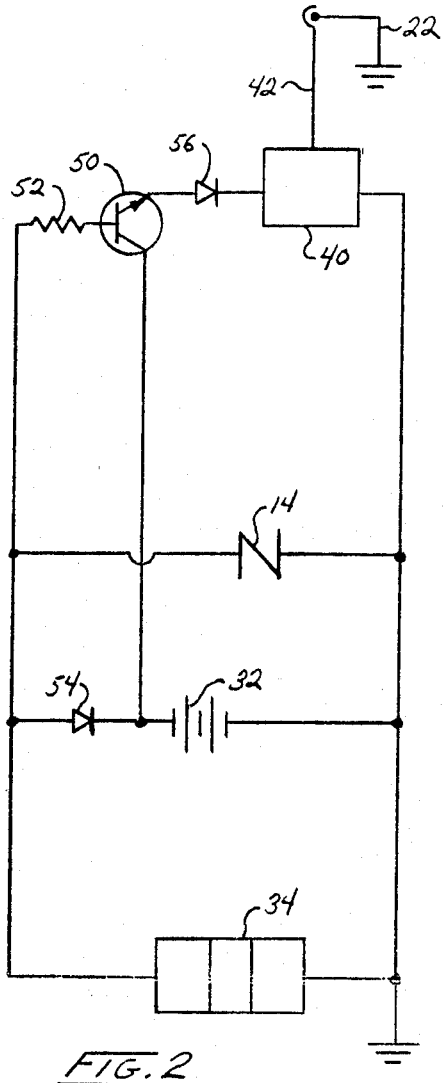
FIG. 2 is a schematic diagram of the control circuit utilized in the gas lamp of FIG. 1.

FIG. 2 illustrates the control circuit employed in gas lamp 10. As noted in FIG. 2, components 14, 22, 32, 34, 40 and 42 are illustrated in FIG. 1. The additional components of the control circuit are transistorized switch 50, bias resistor 52, and blocking diodes 54 and 56.

In the operation of the control circuit and gas lamp 10, gas valve 14 is normally open. Daylight or solar energy received upon the face of photovoltaic solar cell 34 closes valve 14 and develops a bias voltage at the base of transistor 50 through resistor 52 to block any flow of electrical energy from battery 32 through switch 50 to ignitor module 40. However, when diminished light is received at the base of the photovoltaic cell 34 the reduced output voltage functions to permit gas valve 14 to open and switch 50 to switch energy from the rechargeable battery 22 through blocking diode 56 to ignitor module 40. The output of module 40, provides a 1.5 kv electrical charge from 1.5 v battery 32 to ignitor 42. Completion of the circuit from ignitor 42 through the ground wire 22 to ground cause a spark to discharge across the gap between wires 42 and 22 causing the ignition of illuminating gas in the vicinity of mantles 24. When the photovoltaic cell later receives sufficient daylight to inactivate the control, the output from cell 34 functions to close gas valve 14, to recharge battery 32, and also to block the flow of current through switching transistor 50.

Referring to FIG. 3, a suitable decorative frame 60 encloses the assembly 10 above the housing 30. Post 61 is mounted below the housing 30 and extends downward to a place of support such as the ground (not shown).

Referring to FIGS. 3 and 4, cover lens 36 is removably fastened to the housing 30 by suitable means such as screws 37. Solar cell 34 is housed between the lens 36 and circuit board 38, and igniter module 40 is mounted on the circuit board 38. The circuit is behind the solar cell 34. A gasket 41 seals the electronic circuitry from the atmosphere.

Referring to FIG. 5, the battery 32 is removable from the housing 30 by means of removable a cover 33.

Of significance in the concept of this invention is the arrangement whereby solar energy provides for both the function of charging the battery and thereby igniting the lamp but also sensing the outdoor light condition and the requirement that the lamp should be ignited. This is accomplished by providing the biased transistor 50 and diode 56 in parallel with the battery charging circuit 54, 32, 34.

Means may be provided for the setting of, i.e. the controlling of the output of the ignition module 40 so that ignition takes place under differing selected outdoor light conditions.

In a like and conventional manner, an ignition sensor may be provided to redirect the battery energy to the valve 14, if ignition does not occur after a preselected length of time. Such, safety shut-off means are commonly installed in gas burner operations, as well understood by those familiar with the art.

It will be apparent to those skilled in the art from the foregoing that numerous improvements and changes can be made in the embodiments described of the invention without departing from the true scope of the invention. Accordingly, the foregoing disclosure is to be construed as illustrative and not in a limiting sense with the scope of the invention being defined by the appended claims.

I claim:

1. A gas lamp control system regulating the flow of illuminating gas from a gas supply to a mantel head outlet and comprising, in combination:

a. photovoltaic solar cell means;
b. rechargeable battery means;
c. normally-opened electromagnetic gas valve means connected intermediate said gas supply and said mantel head outlet;
d. mantel outlet ignitor means; and
e. circuit means operatively connecting said photovoltaic solar cell means, rechargeable battery means, normally-opened electromagnetic gas valve means, and mantel head outlet ignitor means, said photovoltaic solar cell means generating a bias voltage that closes the flow of illuminating gas through said normally open electromagnetic gas valve means and blocks the flow of electrical energy from said battery means to said ignitor means when energized by daylight.

2. The apparatus defined by claim 1 wherein said rechargeable battery means provides electrical energy to said ignitor means when said photovoltaic solar cell means is de-energized by the absence of daylight.

3. The apparatus defined by claim 1 further comprising a transistorized solid state switch means that is connected to said photovoltaic solar cell means and to said rechargeable battery means, said photovoltaic solar cell means supplying a bias voltage to said transistorized solid state switch means to block the flow of electrical energy to said ignitor means when energized by daylight.

4. The apparatus defined by claim 1 wherein the photovoltaic cell is provided with adjustable output means to select and control the amount of bias voltage generated, to adjust and select the amount of daylight which will open and close the flow of illuminating gas through said normally open electromagnetic gas valve means.

5. In an outdoor gas lamp having a valve for the admission of gas to an illuminating burner area, the improvement comprising providing the valve with electromagnetic opening and closure means which is energized and operated by a rechargeable battery that is recharged by a photovoltaic solar cell and further providing ignition means to ignite gas in the illuminating burner area with the ignition means simultaneously operable with the opening of the gas valve by voltage supplied from the battery.

* * * * *